United States Patent [19]

Gitkin

[11] 4,301,851

[45] Nov. 24, 1981

[54] COMBINED MOVABLE SHUTTER AND AWNING

[75] Inventor: Merrill J. Gitkin, Franklin Lakes, N.J.

[73] Assignee: Gitkin International, Totowa, N.J.

[21] Appl. No.: 63,414

[22] Filed: Aug. 3, 1979

[51] Int. Cl.[3] ..... E04F 10/00

[52] U.S. Cl. ..... 160/46; 160/66; 160/129; 160/133

[58] Field of Search ..... 160/20, 46, 66, 67, 160/128, 129, 133, 183

[56] References Cited

U.S. PATENT DOCUMENTS

| | | | |
|---|---|---|---|
| 3,044,540 | 7/1962 | Hammersley | 160/20 |
| 3,092,170 | 6/1963 | Ellis | 160/133 |
| 3,612,145 | 10/1971 | Darula | 160/67 |
| 4,010,790 | 3/1977 | Varga | 160/133 |

*Primary Examiner*—Philip C. Kannan
*Attorney, Agent, or Firm*—Harvey B. Jacobson

[57] ABSTRACT

A combined movable shutter and awning associated with a door assembly, doorway, or the like, in which the shutter is a roller shutter capable of extension and retraction movable between positions providing a security closure for the door assembly, doorway, or the like, when the guiding trackway assemblies are moved to a position alongside the doorway and providing an awning when the guiding trackway assemblies at each side of the shutter are moved to an outwardly extending relationship to the door assembly, doorway, or the like, and supported in a manner to provide an awning supported in a manner which enables access to the door assembly, doorway, or the like. In one embodiment, the outer end of the combined shutter and awning is supported by vertically disposed support members when in the awning mode so that access to the door assembly, doorway, or the like, is available by persons approaching the door assembly from either side thereof as well as from directly in front of the door assembly with the support structure being collapsible when the combined shutter and awning is positioned in a shutter mode so that operation of the roller shutter is not altered by the presence of the supporting structure. In other embodiments, the trackway assemblies are supported by telescopic inclined braces disposed above or below the awning when in the awning mode.

4 Claims, 10 Drawing Figures

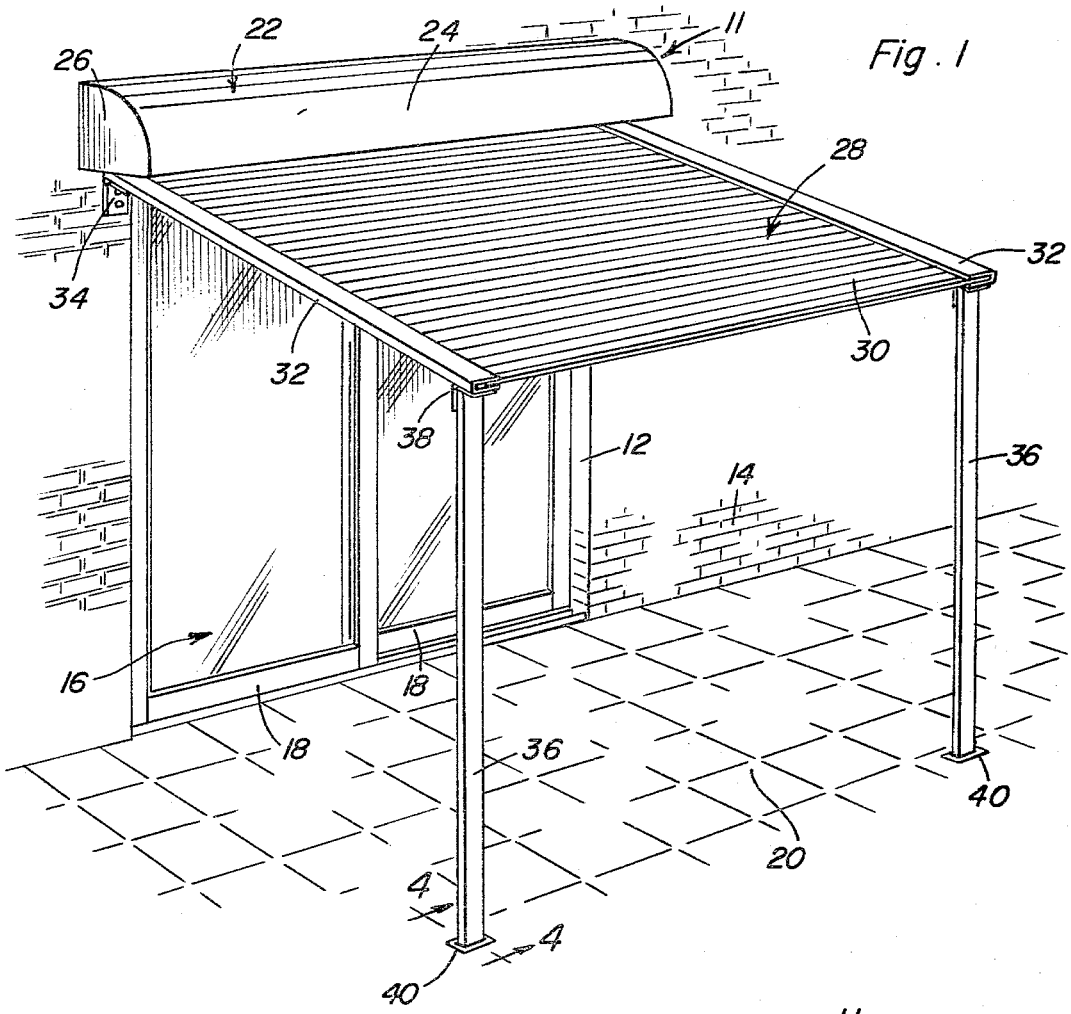
Fig. 1
Fig. 3
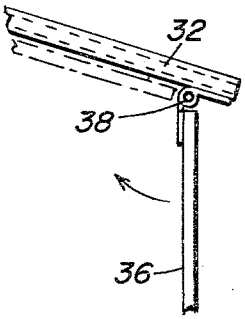
Fig. 4
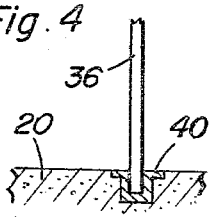
Fig. 2
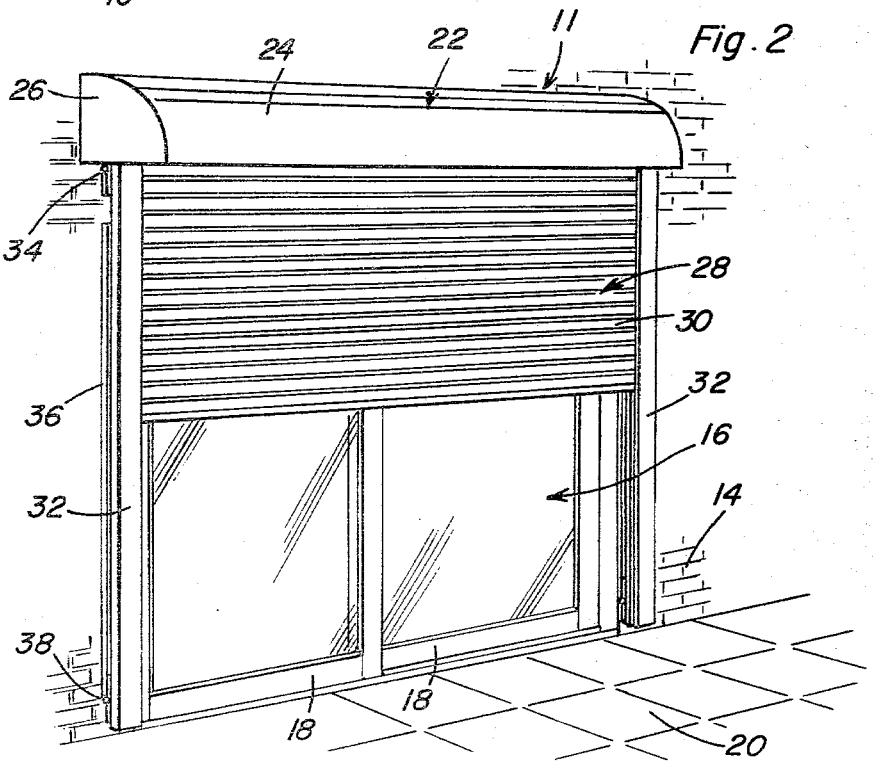

COMBINED MOVABLE SHUTTER AND AWNING

BACKGROUND OF THE INVENTION

1. Field of the Invention

The present invention generally relates to a combined roller shutter and awning for a door assembly such as a sliding glass door arrangement providing access between the interior of a building, such as a residence, to a patio, terrace, yard, or the like, with the supporting structure for the shutter and awning being collapsible and extendible when moving the assembly between its shutter mode and its awning mode with the supporting structure extending vertically or angularly from the outer end of the awning to the wall structure of a building when in awning mode and in closing relation to the door assembly when in shutter mode.

2. Description of the Prior Art

Movable shutters have been provided for building window openings which, when in their extended position, provide security for the window opening, and when in their retracted position, provide passage of light, air, and the like, through the window opening. Additionally, movable security panels have been provided for door assemblies, show windows, and the like, in various retail merchandising stores where it is desirable to provide protection for the contents of the show windows, building, and the like. Further, shutters used with windows and convertible to awnings have been provided that include a supporting brace structure which extends from the outer end of the awning in a generally horizontal direction to the window frame or adjacent building wall and such convertible shutter and awning combinations have also been employed with show windows, and the like, but in such installations, the supporting brace rod structure must be elevated to a height substantially above the height of pedestrians or other persons passing under the awning in order to prevent injury. The following U.S. patents disclose those structures known to applicant relevant to the above-described structure.

U.S. Pat. No. 3,595—May 25, 1844
U.S. Pat. No. 330,956—Nov. 24, 1885
U.S. Pat. No. 1,022,939—Apr. 9, 1912
U.S. Pat. No. 2,513,042—June 27, 1950
U.S. Pat. No. 2,545,400—Mar. 13, 1951
U.S. Pat. No. 2,906,323—Sep. 29, 1959
U.S. Pat. No. 3,065,785—Nov. 27, 1962
U.S. Pat. No. 4,010,790—Mar. 8, 1977.

SUMMARY OF THE INVENTION

An object of the present invention is to provide a combined movable shutter and awning for patio doors, and the like, capable of being positioned in a shutter mode to provide security for the patio doors and an awning mode to provide protection from the sun and inclement weather as well as provide an attractive addition to a patio door assembly.

Another object of the invention is to provide a combined shutter and awning in which guide tracks for the movable shutter are pivotally connected to the housing for the shutter mechanism for pivotal movement to an outwardly extending position with collapsible support structure being attached to the tracks of the shutter with embodiments providing positioning in a vertical position, an inwardly and downwardly inclined position and an upwardly and inwardly inclined position when in the awning mode thereby providing collapsible support for the outer end of the awning.

A further object of the invention is to provide a combined movable shutter and awning in accordance with the preceding objects which enables conventional shutter structure to be utilized and operated in the usual manner with the structural modifications which enables conversion from a shutter mode to an awning mode being quite simple and relatively inexpensive with the support structure for the awning serving to securely support and anchor the outer end of the awning and being generally in the form of a telescopic or adjustable support member.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the combined roller shutter and awning in the awning mode.

FIG. 2 is a perspective view of the invention in the shutter mode.

FIG. 3 is a fragmental side elevational view of the connection between the side track structure for the roller shutter and the collapsible support member therefor.

FIG. 4 is a fragmental sectional view taken generally along section line 4—4 of FIG. 1 illustrating a structure for anchoring the lower end of the supporting structure for the outer end of the awning.

DESCRIPTION OF THE PREFERRED EMBODIMENT

Figure 5:
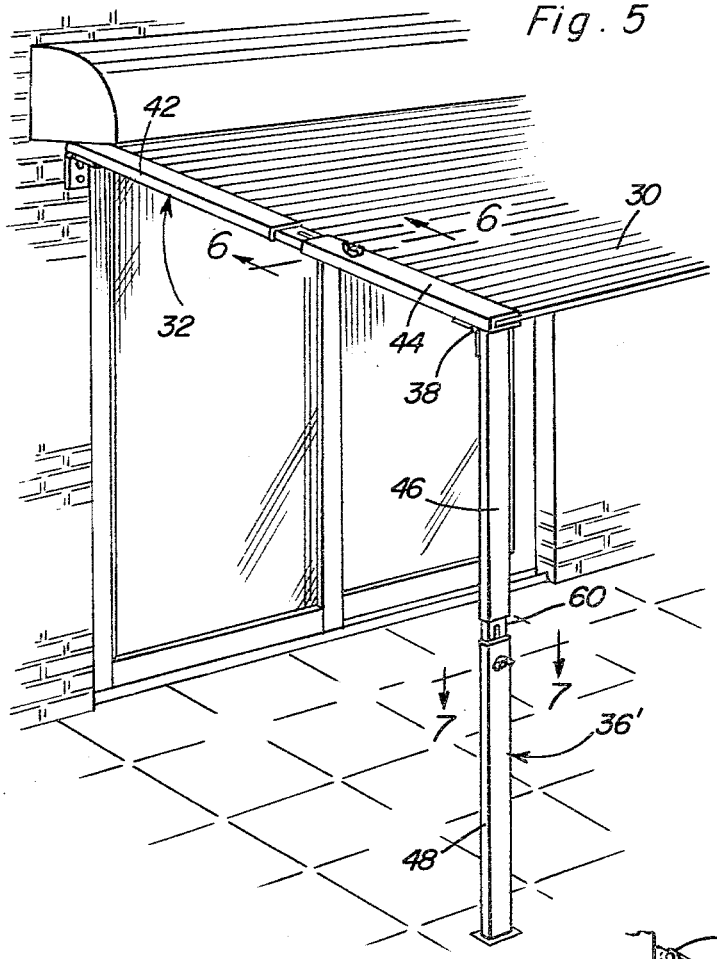
FIG. 5 is a fragmental perspective view, similar to FIG. 1, illustrating the telescopic adjustment of the guide tracks and support members.

Referring now specifically to FIGS. 1–4 of the drawings, the combined movable shutter and awning of the present invention is generally designated by numeral 11 and is illustrated in association with a doorway 12 in a building wall 14, such as a residence or other building in which individuals pass through the doorway 12. The doorway 12 is closed by a door assembly 16 such as sliding glass doors 18 to provide access to a patio 20 or similar areas. Sliding glass doors 18 in some instances do not provide adequate security and the combined shutter and awning 11, when in the shutter mode, will provide security for the door assembly 16 as illustrated in FIG. 2 with the shutter being illustrated in partially closed position. When the shutter is completely closed, unauthorized entry through the doorway 12 will be effectively prevented and when the shutter is completely retracted or rolled up, it will not interfere with passage through the doorway 12.

The shutter and awning assembly includes a horizontally disposed housing 22 which includes a top wall 24 and end walls 26 of conventional construction for receiving a conventional roller shutter and actuating mechanism in which the shutter 28 is constructed of a plurality of slats 30 hingedly interconnected in any suitable manner and supported by rollers or other means movable in side tracks 32 which are in the form of inwardly facing channel-shaped members. The roller shutter in and of itself including the side tracks 32 are conventional in construction as is the reel mechanism and actuating mechanism for the shutter so that when the shutter 28 is retracted, it will be substantially completely received in the housing 22 and when it is completely extended, it will form a security closure for the doorway 12 thereby precluding unauthorized passage through the door assembly 16.

The side tracks 32 are modified to the extent that a hinge structure 34 connects the upper ends of the side tracks 32 to wall 14 or the housing 22 which enables the side tracks 32 to move from a vertical position alongside of or nested within the doorway 12 to a generally outwardly, horizontally and downwardly inclined position when converting the shutter to an awning with the two positions of the tracks 32 being illustrated in FIGS. 1 and 3. The structure of the roller shutter is such that the side tracks 32 may be pivoted about the hinge axis defined by the hinges 34 when the shutter 28 is in any position such as in the fully extended position as illustrated in FIG. 1. To support the outer end of the tracks 32 when in the awning mode, each track 32 includes a supporting post 36, standard, or the like, in the form of a rigid member of any suitable cross-sectional configuration, such as a box-shaped tubular metallic member of aluminum, or the like. The supporting member 36 is hingedly attached to the undersurface of the side track 32 by a hinge structure 38 to enable the supporting member 36 to pivot between a position alongside of or in underlying relation to the side track 32, as illustrated in broken line in FIG. 3, to a generally vertical position to support the outer end of the awning from the patio deck 20, or the like.

FIG. 4 illustrates one manner of providing a means for connecting the lower ends of a supporting post or member 36 to a supporting surface and includes a relatively simply provided female receptacle 40 inserted into the patio deck 20, or the like, so that the upper surface of the female receptacle is flush with the surface 20 so that it will not provide projections which could form a hazard when the supporting posts 36 are not positioned therein. The female receptacle 40 is positioned such that the supporting posts 36 are substantially parallel to the building wall 14 and spaced away from the doorway 12 a distance corresponding to the length of the side tracks 32. If the area over which the awning is supported is such that a grass or soil area underlies the outer end of the awning, then the lower ends of the supporting posts 36 may be provided with a pointed ground inserting member preferably having a horizontal flange spaced from the pointed end thereof to limit the insertion into the ground surface and to facilitate the insertion of the pointed end by providing a plate on which a foot may be placed to press the pointed end of the post 36 into the ground. If desired, a suitable locking device may be provided between the lower end of the post and the patio deck 20 such that a positive anchor is provided for the outer end of the awning to preclude the possibility of a sudden wind lifting the awning upwardly. This may be accomplished by any of various conventional structures, such as a latch structure which enables the post to be merely inserted into the receptacle and automatically latched therein with the latch being manually releasable to remove the lower end of the post 36. The specific details of the structure for connecting the post 36 to the patio deck may be varied depending upon installational requirements and the specific hinge structures provided between the posts 36 and the side tracks 32 may be conventional and secured in any suitable manner as are the hinge structures 34 between the tracks 32 and the housing 22 or building wall 14.

Essentially, the structure involves the provision of a convertible roller shutter and awning in which the side tracks of the awning are pivotal to an outwardly extended position and supported by support members attached to the outer end portions of the side tracks 32 with the support members being substantially vertical so that unimpeded access is provided to the door assembly 16 from either side of the door and from directly in front of the door and also pedestrian traffic may pass under the side tracks 32 without any danger whatsoever of contacting any horizontal braces, rods, or the like, which permits the housing 22 to be positioned closely adjacent the upper end of the door rather than being elevated substantially above the door which is necessary if horizontal braces are used to support the outer ends of the side tracks. Thus, a relatively simple but yet dependable and effective combined roller shutter and awning is provided in which the assembly may be easily changed from the shutter mode to the awning mode with the assembly in the shutter mode providing effective security for the door assembly and doorway and providing effective protection from the sun and inclement weather when in the awning mode.

Figure 6:
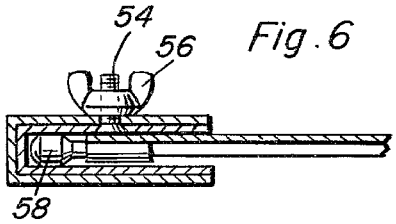
FIG. 6 is a sectional view taken along section line 6—6 of FIG. 5.
Figure 7:
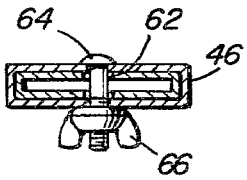
FIG. 7 is a sectional view taken along section line 7—7 of FIG. 5.
Figure 8:
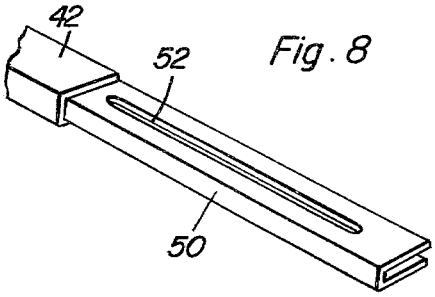
FIG. 8 is a fragmental perspective view of the slotted end of one of the adjustable members.

FIGS. 5–8 disclose a structure which may be incorporated into the arrangement illustrated in FIGS. 1–4 by virtue of which the effective length of the supporting member and the effective length of the guide tracks may be adjusted. Since the remainder of the structure is the same as that illustrated in FIGS. 1–4, the same reference numerals are applied thereto. Each guide track 32' includes longitudinally adjustable sections 42 and 44 and each post 36' includes adjustable sections 46 and 48. As illustrated in FIGS. 5, 6 and 8, the section 42 of the guide track 32' includes a reduced axial extension 50 provided with a longitudinal slot 52 which extends through the upper flange of the channel-shaped construction of the section 42 with the ends of the slot 52 being closed and receiving a headed fastener 54 therethrough having a wing nut 56 on its upper end. The fastener 54 also extends through an appropriate aperture in the upper flange of the track segment 44 thereby enabling longitudinal adjustment of the section 44 of the trackway in relation to the section 42 of the trackway 32'. This provides for variation in the distance between the building wall and the hinge structure 38 and still provides a continuous track for a roller 58 on the end of each of the panels 30 to facilitate movement of the awning from its retracted to its extended position.

The post 36' is preferably of box-shaped configuration and the upper section 46 is provided with a reduced axial extension 60 having a longitudinal slot 62 therein which receives a fastening bolt 64 having a wing nut 66 thereon by which the vertical effective length of the post 35′ can be varied. While longitudinal slots, bolts and wing nuts have been shown to vary the effective length of the guide tracks and supporting posts, it is pointed out that other conventional telescopic adjustment means may be provided in these components and also may be provided where the hinge structure attaches the upper end of the post to the side tracks thereby facilitating the installation of the combined shutter and awning in association with various building structures, doorways, and the like.

Figure 9:
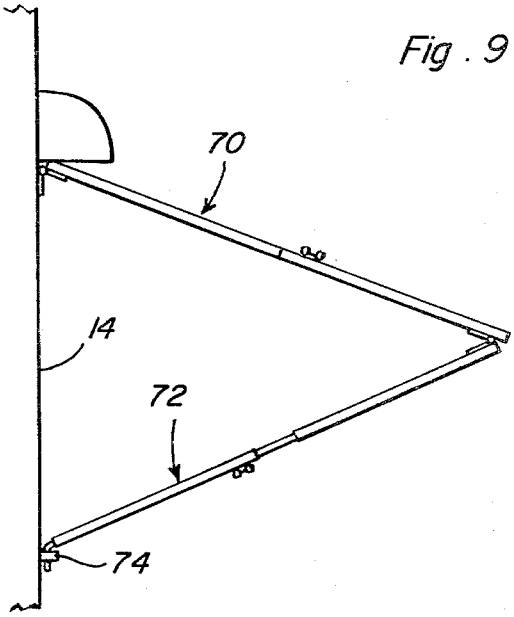
FIG. 9 is a side elevational view of another embodiment of the invention in which a brace extends inwardly and downwardly from the outer end of the awning.

FIG. 9 illustrates another embodiment of the invention in which the awning and shutter assembly is generally designated by the numeral 70 and is the same as that illustrated in the preceding figures, but in this structure, the post 36 or 36′ is in the form of an inwardly and downwardly inclined brace generally designated by the numeral 72 that has its inner end attached to the wall 14 of the building at an elevation enabling proper support of the awning and access to the doorway with the inner end of the brace 72 being connected to the wall 14 by a suitable bracket structure 74. While the angular relationship may vary, it is preferable for the included angle between the awning and brace rod to be approximately 90° and the included angle between the awning and building wall and between the brace and building wall being approximately 45° although this angle may vary depending upon installational requirements.

Figure 10:
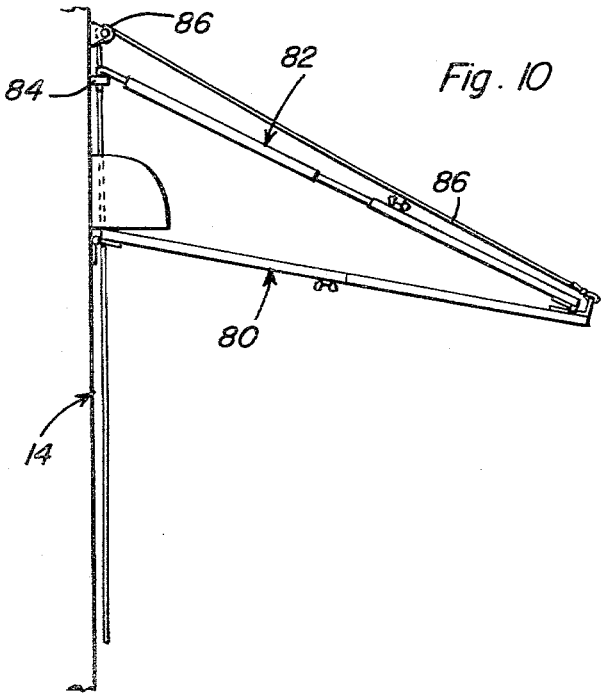
FIG. 10 is a side elevational view of another embodiment of the invention in which a brace extends inwardly and upwardly from the outer end of the awning.

FIG. 10 illustrates another embodiment of the invention in which the combined shutter and awning is generally designated by the numeral 80 and in this arrangement, a brace generally designated by the numeral 82 which may be similar in structure to the post 36 or 36′ extends inwardly and upwardly from the outer end of the combined awning and shutter and is removably anchored or connected to the building wall structure by a bracket 84. Also, a pulley may be anchored alongside of or above the bracket 84 receiving a pull cord or cable to enable the angular position of the awning 80 to be varied. This structure enables the lower end of the awning to be swung outwardly from its position in overlying relation to the doorway and then lifted to the desired awning position by using the lift cord or cords 86 connected to the outer end of the side tracks and entrained over the pulley or pulley assemblies 88 connected to the wall 14 to enable lifting of the awning to its awning position and connection of the brace assemblies 82 to the bracket 84.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A combined shutter and awning for a doorway and door assembly comprising a housing mounted immediately above the doorway, depending side tracks, a shutter assembly movably guided by said tracks, means hingedly supporting the upper ends of the tracks for swinging movement about a generally horizontal axis adjacent the upper edge of the doorway for movement of the tracks and shutter assembly to an outwardly extending generally horizontal position in relation to the doorway, and support means hingedly connected to the outer ends of the side tracks for supporting the outer ends of the side tracks when in their extended position whereby the shutter assembly between the side tracks will form an awning for the doorway, said support means for the outer ends of the tracks being in the form of vertically disposed support members generally parallel to the doorway but spaced therefrom to provide access to the doorway from the front and both sides of the doorway and enable unimpeded passage of individuals from side-to-side of the awning with the space enclosed by the side tracks, support members, doorway and supporting structure being free of obstructions, said doorway providing access between the exterior and the interior of a building with a door forming a closure for the doorway, said shutter assembly when in the shutter mode and extended completely covering doorway and door thereby providing security to prevent unauthorized passage through the door, said supporting means for the outer ends of the tracks including support posts, hinge means connecting the upper end of each support post to the outer end portion of a side track, and means spaced outwardly of the doorway engaging the lower end of the post to anchor it to a supporting surface for securely supporting the outer end of the shutter assembly when it is in awning mode, said supporting post being slightly shorter in length than the side track thereby supporting the side tracks in slightly downwardly and outwardly inclined relation to the inner end of the side tracks when in the awning mode, said means supporting the side tracks for pivotal movement including a hinge structure supporting the inner end of the side tracks from the housing to enable the shutter assembly to be retracted and extended when the side tracks are in vertical position and to enable the shutter assembly to be moved to its awning mode by pivoting the side tracks outwardly and upwardly and swinging the support posts downwardly to a substantially vertical position.

2. In combination with a door providing access to the interior of a building, a combined shutter and awning comprising a pair of spaced guide members positioned vertically alongside the door, an extendible and retractable shutter mounted from said guide members for securely covering and uncovering the door, means supporting the upper ends of the guide members for pivotal movement thereof to an outwardly and downwardly inclined position with the inner ends of the guide members being disposed adjacent the upper edge of the door, and pivotal anchor means at the outer end portion of the guide members to support the guide membes and shutter in an awning mode, said pivotal anchor means including a longitudinally adjustable member to enable installation of the shutter and awning in association with various building and door arrangements, said spaced guide members including means enabling longitudinal adjustment of the length to facilitate installation in association with various building and door arrangements.

3. In combination with a door providing access to the interior of a building, a combined shutter and awning comprising a pair of spaced guide members positioned vertically alongside the door, an extendible and retractable shutter mounted from said guide members for securely covering and uncovering the door, means supporting the upper ends of the guide member for pivotal movement thereof to an outwardly and downwardly inclined position with the inner ends of the guide members being disposed adjacent the upper edge of the door, and pivotal anchor means at the outer end portion of the guide members to support the guide members and shutter in an awning mode, said anchor means including an inwardly and upwardly extending brace means connected to the building wall above the upper end of the guide members.

4. The structure as defined in claim 3 together with means connected with the outer end of the combined shutter and awning and the building wall for elevating the outer end of the shutter and guide members from a generally vertical shutter mode to an outwardly extending awning mode.

* * * * *